United States Patent [19]

Saint

[11] 4,105,247

[45] Aug. 8, 1978

[54] HIGH CHAIR WITH TRAY FASTENING

[75] Inventor: David Saint, Elverson, Pa.

[73] Assignee: Graco Metal Products, Inc., Elverson, Pa.

[21] Appl. No.: 775,890

[22] Filed: Mar. 9, 1977

[51] Int. Cl.[2] ..... A47B 39/00

[52] U.S. Cl. ..... 297/149

[58] Field of Search ..... 297/148–155, 297/251, 252

[56] References Cited

U.S. PATENT DOCUMENTS

| | | | |
|---|---|---|---|
| 1,003,245 | 9/1911 | Emmons | 297/153 |
| 2,024,667 | 12/1935 | Stinson | 297/149 |
| 2,478,280 | 8/1949 | Kroll et al. | 297/151 |
| 3,027,202 | 3/1962 | Gottfried et al. | 297/151 |
| 3,330,597 | 7/1967 | Lay et al. | 297/148 |
| 3,383,134 | 5/1968 | Webb et al. | 297/153 |

FOREIGN PATENT DOCUMENTS

| | | | |
|---|---|---|---|
| 464,806 | 4/1937 | United Kingdom | 297/149 |

*Primary Examiner*—James T. McCall

*Attorney, Agent, or Firm*—Z. T. Wobensmith, 2nd; Z. T. Wobensmith, III

[57] ABSTRACT

A high chair is provided having tubular metal arms of special configuration and with spaced grooves for locking a tray, the tray having resiliently urged locking hooks fo engagement below the arms in a plurality of positions by one or the other of double hook portions, one of which hook portions retains the tray against separation from the arms and the other of which retains the tray against separation from the arms and also locks the tray against forward or rearward movement, the tray being readily removed by manual retraction of the locking hooks.

5 Claims, 9 Drawing Figures

HIGH CHAIR WITH TRAY FASTENING

BACKGROUND OF THE INVENTION

1. Field of the Invention

This invention relates to high chairs and to a tray fastening therefor.

2. Description of the Prior Art

It has heretofore been proposed to detachably mount a tray on the arms of a high chair but the fastenings heretofore available had various shortcomings including complexity of the parts, failure to remain in place on the arms after initial application unless the latching members are positively engaged, unreliability or difficulty in positioning and securing the tray in place, as well as hazards to the child or other user.

Stinson, U.S. Pat. No. 2,024,667; Kroll et al., U.S. Pat. No. 2,478,280; and Anderson, U.S. Pat. No. 2,799,324 all show wooden arms with guide members or brackets attached thereto for engagement by locking members on the tray and require careful attention for assembly and retention of the tray.

Hamilton, U.S. Pat. No. 2,728,378; Webb et al., U.S. Pat. No. 3,383,134 and Siegel U.S. Pat. No. 3,490,808 show holding devices for trays which are directly latched onto tubular arms of a high chair but these must be carefully positioned for locked engagement. In Webb et al. and Hamilton the latching member is on a vertical pivot at one end while Siegel has a slidable bolt to that continuous manual holding is required until the latching operation is completed, otherwise the tray can be lifted from the arms.

Benoit et al., U.S. Pat. No. 3,511,531, shows hollow tubing, substantially square in shape with a plurality of holes for engagement by terminal fingers 46 of spring pressed levers 34 on each side. The spacing of the holes permits only a coarse tray adjustment from front to rear. The tray is not retained from vertical separation unless the fingers 46 are engaged.

None of the prior art devices show spring urged hooks for engagement with a selected groove on tubular chair arms in which a hook surface is provided which is self-tightening, which is free from rattle and in which a double hook action is effective so that as soon as the tray is applied vertically to the arms the hooks prevent lifting of the tray so that the tray is in a safe position and remains so whether or not the hooks are engaged in the positioning grooves on the arms. At the same time the tray can be readily moved horizontally forwardly or rearwardly to a position in which it is locked against further movement.

SUMMARY OF THE INVENTION

In accordance with the invention a tray fastening is provided which engages with horizontal tubular chair arms the structure being strong, safe, easily initially applied to the chair arms by retraction of the spring urged locking hooks, the hooks being spring driven to tighten on the chair arms and avoid rattle, the hooks having a plurality of retaining positions, initiation of the application by release following such retraction effecting an initial retention of the tray against vertical movement even if the hooks are not engaged in their locking grooves the engagement in the grooves holding the tray against forward or rearward movement. At the same time the tray can be readily released, if desired.

It is the principal object of the invention to provide an improved hook fastening for attaching a tray to the arms of a high chair which is strong, safe ad free from rattle, the tray being easily applied from the top without the necessity for stooping to find a location for locking and which may be easily removed, the lock fastening being spring driven to holding positions.

It is a further object of the invention to provide apparatus of the character aforesaid which provides a safer tray fastening than has heretofore been available.

It is a further object of the invention to provide apparatus of the character aforesaid which overcomes the shortcomings of the fastenings for trays heretofore available.

Other objects and advantageous features of the invention will be apparent from the description and claims

BRIEF DESCRIPTION OF THE DRAWINGS

The nature and characteristic features of the invention will be more readily understood from the following description taken in connection with the accompanying drawings forming part hereof in which.

Figure 1:
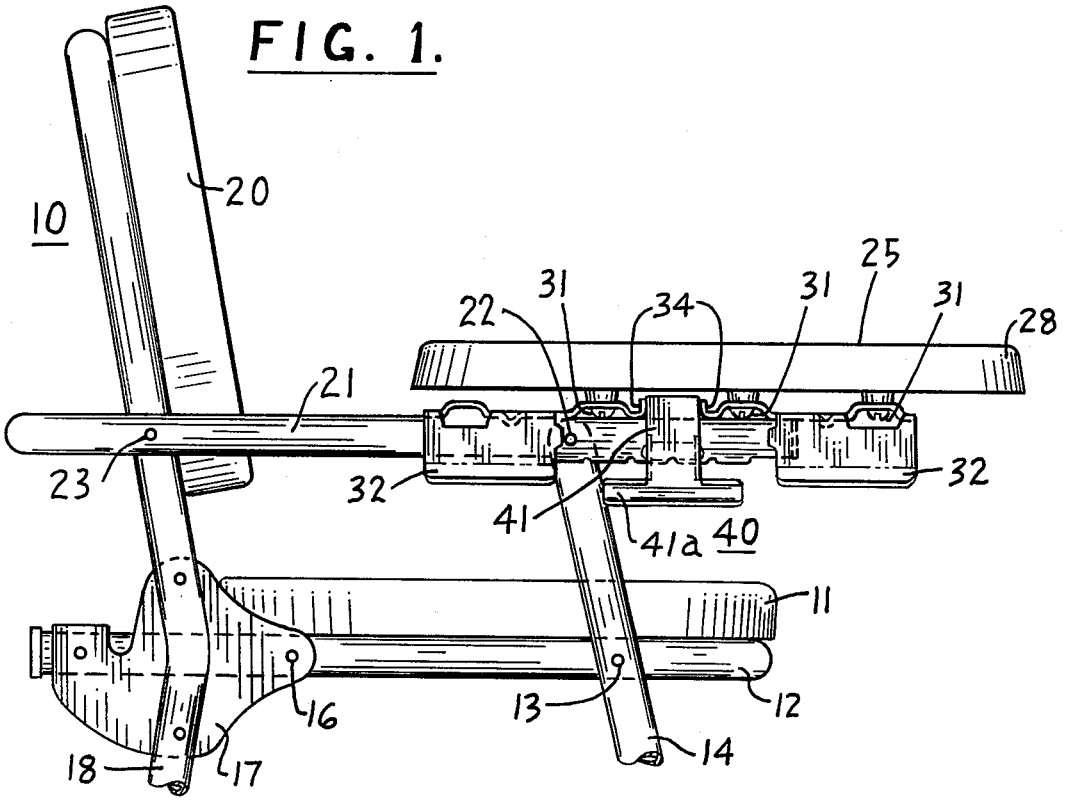
FIG. 1 is a side elevational view of a portion of a high chair with a tray thereon held by fastening structure in accordance with the invention.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF A PREFERRED EMBODIMENT

Referring now more particularly to the drawings a high chair, foldable for storage, is shown generally at 10, having a seat 11 carried on a tubular seat frame 12. The seat frame 12 is pivotally connected at 13 to front tubular legs 14 and pivotally connected at 16 to brackets 17 mounted on the rear tubular legs 18.

The rear legs 18 extend upwardly and are connected at the top to provide a support for a back pad 20.

At the top ends of the front legs 14, tubular side arms 21, connected together at their rear ends to provide a U-shaped are pivotally connected by pivots 22, the side arms 21 being pivotally connected by pivots 23 to the upper extensions of the rear legs 18 to which the back pad 20 is secured.

The foregoing structure is well known and is merely illustrative of a high chair for which the fastening structure of the present invention is suitable.

A tray 25 is provided molded of synthetic plastic material and having a top supporting portion 26 surrounded by a rim 27 and with downwardly extending flanges 28 and downwardly extending attaching lugs 29.

A stamped sheet metal mounting bracket 30 is provided on each side which is secured to the lugs 29 by bolts 31 engaged in the lugs 29. The bracket 30 has outer flanges 32 and inner flanges 33 for stiffening and spaced upwardly extending hinge lugs 34 disposed between the rearmost pair of attaching lugs 29.

The bracket 30 has struck down pad portions 35 for sliding engagement with the top of the arms 21 as hereinafter explained.

A locking hook 40 is provided preferably made as a sheet metal stamping with a central plate portion 41 and a curved actuating handle **41*a* extending therefrom for manual actuation. The plate portions 41 have side flanges extending therefrom with hinge lugs 42. A hinge pin 43 extends through the hinge lugs 42 and the hinge lugs 34 for pivotal mounting of the locking hook 40. The locking hook 40, both by reason of the distribution of its weight and the location of the hinge pin 43, relative to the arms 21, normally, upon release, moves inwardly to a holding position. A coil spring 45 carried on the hinge pin 43 and with one end 45*a* engaging and held by the plate portion 41 and the other end 45*b* engaging a rib 47 carried on the bracket 30 to urge the locking hooks 40** inwardly.

The side flanges have spaced hooks 48 having exterior stiffening ribs 49. The hooks 48 have upper curved edges 50 with outer notches 51 and inner notches 52. The curved hooks 48 in their normal inward positions to which they are urged by the springs 45 extend below and inwardly beyond the side arms 21.

The forward end portions of the side arms 21 provide locations for adjustable support of the tray 25 and shaped as shown in detail in FIGS. 4, 5, 6, 7, and 8. An upper and inner curved portion 55 extends as a continuation of the circular curvature at the rear of the arms 21, with flat side faces 56 converging with respect to an inwardly inclined plane and with a lower curved connecting portion 57. At spaced intervals along the portions 57 grooves 58 are provided for engagement by the curved edges 50 of the hooks 48.

The mode of operation will now be pointed out.

Figure 2:
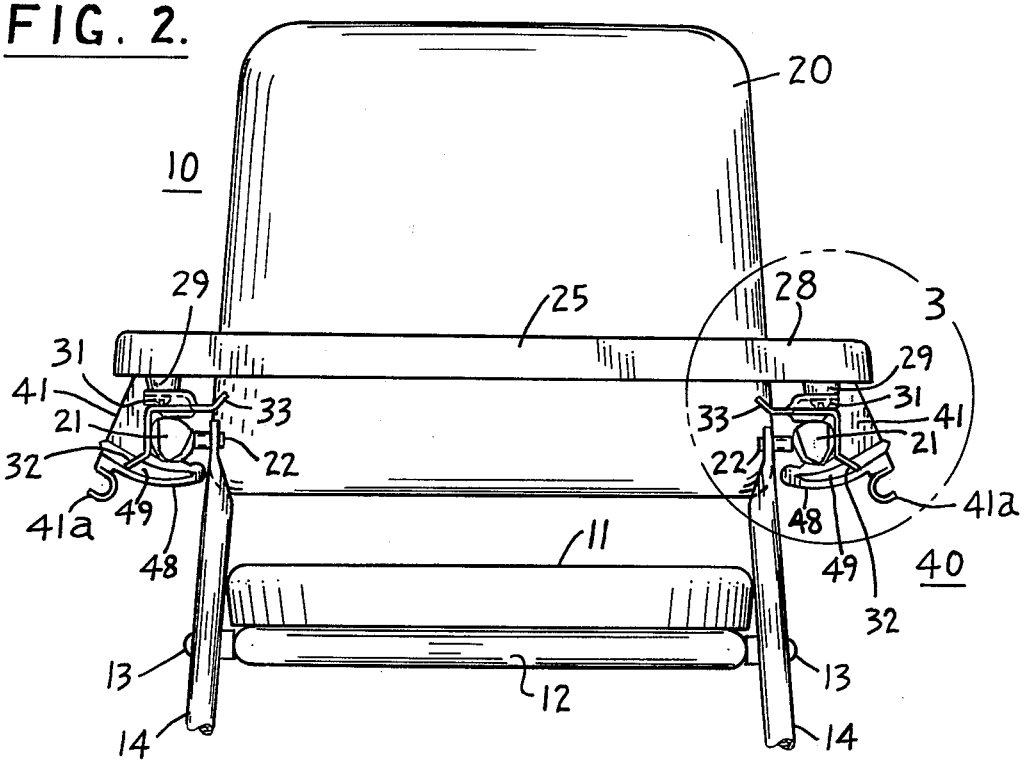
FIG. 2 is a front elevational view of the structure shown in FIG. 1, but with the locking hooks in different positions.
Figure 3:
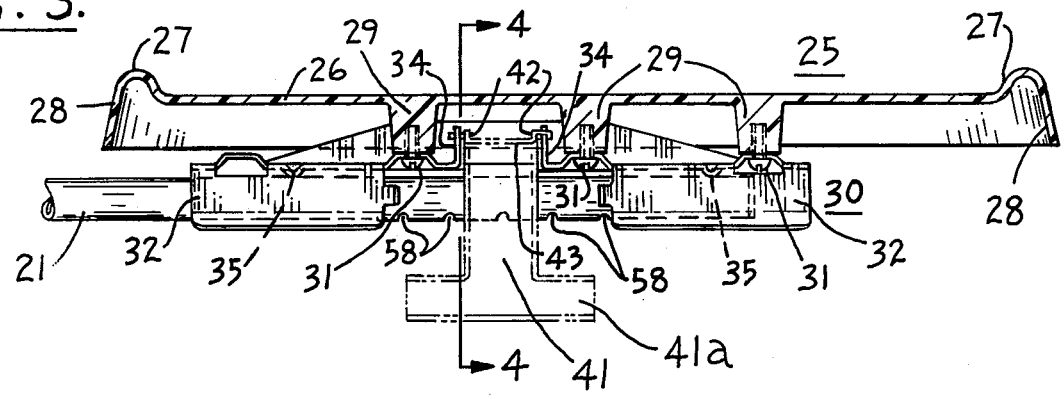
FIG. 3 is a side elevational view, on a larger scale than FIG. 1 showing one of the chair arms, the tray, and the fastening structure.

With the high chair 10 in position for use as shown in FIGS. 1 and 2 and it is desired to attach the tray 25, the tray 25 is grasped from each side. The fingers are engaged with the handles 41a and these are raised to their upper positions so that hooks 48 are in their upper positions.

The tray 25 while thus held is lowered, with the brackets 30 above the arms 21 at the front. If, now, the handles 41a are released the hooks 48 are impelled so that the hooks 48 are beneath the front ends of the arms 21.

Normally the curved edges 50 will not be engaged in the grooves 58.

In the position of the hooks 48 just stated if the tray 25 is lifted the hooks 48 will by their positioning beneath the arms 21 prevent separation from the arms 21.

From the position just referred to, the tray 25 may be moved horizontally forwardly or rearwardly as desired a short distance to permit the hooks 48 by a camming action to engage in the grooves 58, further urged therein into by the springs 45. The spring driven hooks 48 with their cam slopes beyond each hook portion tighten the tray against the arm rests preventing rattling whether or not the hooks 48 are in grooves 58.

If a further adjustment of the position of the tray 25 is desired, the handles 41 may be raised slightly with the fingers to release the hooks 48 from engagement in the grooves 58 to permit rearward or forward horizontal movement of the tray 25.

Figure 4:
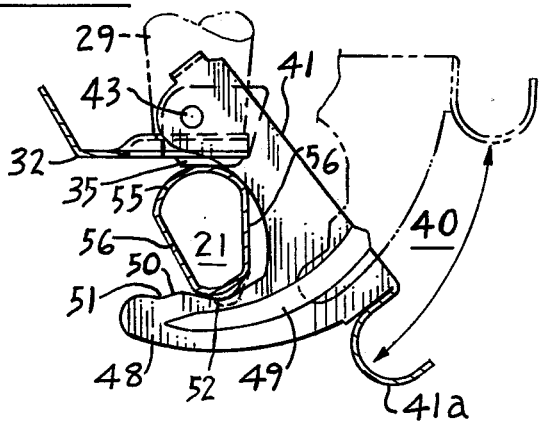
FIG. 4 is a vertical sectional view, enlarged, taken approximately on the line 4—4 of FIG. 3 and showing the locking lever in locked position.
Figure 5:
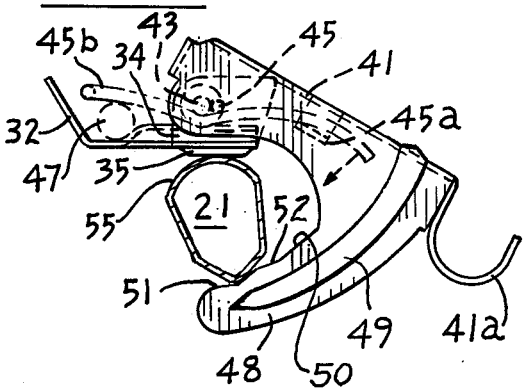
FIG. 5 is a central sectional view through the locking lever in a tray holding position prior to locking.
Figure 6:
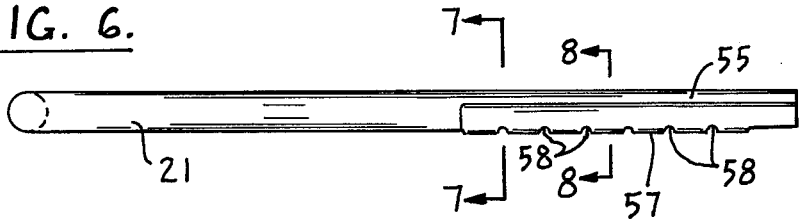
FIG. 6 is a side elevational view of the tubular arm of the high chair of FIG. 1.
Figure 7:
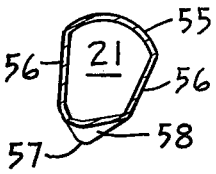
FIG. 7 is a transverse sectional view, enlarged, taken approximately on the line 7—7 of FIG. 6.
Figure 8:
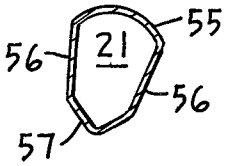
FIG. 8 is a transverse sectional view, enlarged, taken approximately on the line 8—8 of FIG. 6.
Figure 9:
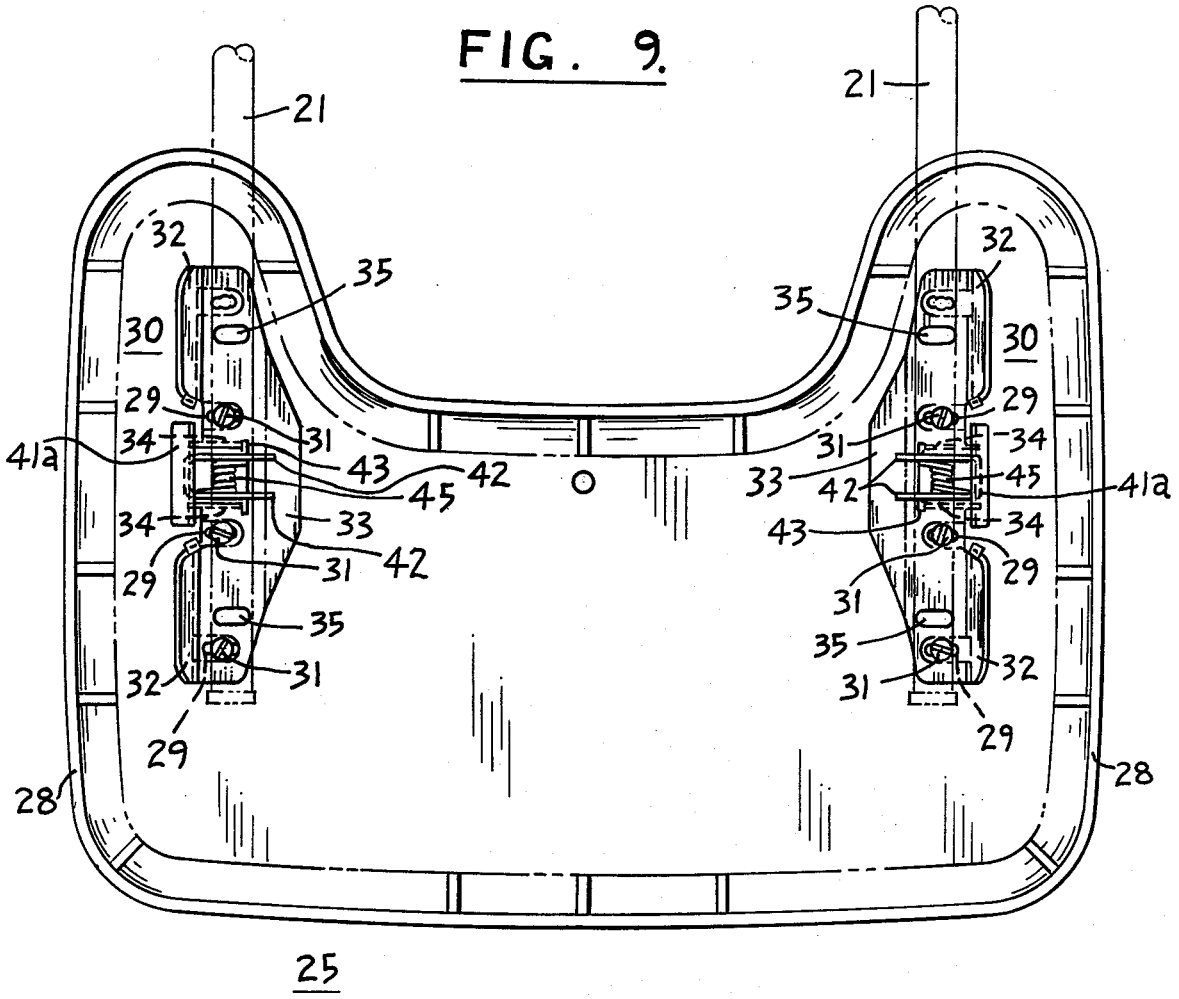
FIG. 9 is a plan view as seen from below of the tray, the high chair arms and the fastening structure of the high chair and tray shown in FIG. 1.

It will be noted that there is a double hook action since in one position of the locking hook 40 as shown in FIG. 5 and which is a holding position the notches 51 of the hooks 48 are in engagement with the lower parts 57 of the arms 21. In another position of the locking hook 40, as shown in FIG. 4, the hooks 48 have the inner notches 52 positioned in engagement in the arm grooves 58. In each position and with the locking hooks 40 beneath the arms 21, separation of the tray 25 from the arms 21 is prevented and the tray 25 is in a safe position.

It will also be noted that the shape of the forward portion of the arms 21 as can be seen particularly in FIGS. 4, 5, 6, 7, and 8, provides locking grooves 58 which are effective and free from objectionable surfaces or projections.

The mounting bracket 30 by reason of its open character from below permits movement of the tray 25 downwardly for application to the arms 21 thereby facilitating mounting and attachment and avoiding any necessity for lining up the bracket with the from ends of the arms 21 for mounting.

I claim:

1. In combination with a chair having closed tubular arms and a tray for detachable connection to said arms, the means for detachably connecting said tray which comprises horizontally spaced mounting brackets carried by said tray and open from below for positioning on each of said arms, locking hook members pivotally mounted on each of said brackets on horizontal pivots parallel to said arms and each having an operating handle and a hook for swinging movement to different engaging positions beneath one of said arms, and said hooks in any of said positions preventing removal of said tray, said arms having spaced transversely grooved portions for engagement of said hooks therein, said hooks having a plurality of positions in one of which said hooks engage said arms intermediate said grooved portions.

2. In combination with a chair having closed tubular arms and a tray for detachable connection to said arms, the means for detachably connecting said tray which comprises horizontally spaced mounting brackets carried by said tray and open from below for positioning on each of said arms, locking hook members pivotally mounted on each of said brackets on horizontal pivots parallel to said arms and each having an operating handle and a hook for swinging movement to different engaging positions beneath one of said arms, and said hooks in any of said positions preventing removal of said tray, said arms having spaced transversely grooved portions for engagement of said hooks therein, each of said locking hook members has a plurality of parallel spaced hooks for engagement with said arms, the portions of said arms for hook engagement have a plurality of spaced grooves along the lower part thereof for hook engagement, each of said hooks having an edge portion for contact with said arms between said grooves for permitting limited horizontal movement of said tray and another edge portion for locked engagement in said grooves.

3. In combination with a chair having closed tubular arms and a tray for detachable connection to said arms, the means for detachably connecting said tray which comprises horizontally spaced mounting brackets carried by said tray and open from below for positioning on each of said arms, locking hook members pivotally mounted on each of said brackets on horizontal pivots parallel to said arms and each having an operating handle portion for moving said hook members to release positions, and a hook for swinging movement to different engaging positions beneath said arms.

said locking hook members having weight distribution effective for moving said hook to arm engaging position, and said hooks in any of said engaging positions preventing removal of said tray.

4. In combination with a chair having closed tubular arms and a tray for detachable connection to said arms, the means for detachably connecting said tray which comprises horizontally spaced mounting brackets carried by said tray and open from below for positioning on each of said arms, locking hook members pivotally mounted on each of said brackets on horizontal pivots parallel to said arms and each having an operating handle portion for moving said hook members to release positions, and a hook for swinging movement to different engaging positions beneath said arms, said arms having portions for hook engagement with upper face portions for bracket engagement, converging said face portions and a bottom portion, and transversely grooved portions spaced along said bottom arm portions for engagement of said hooks therein, said hooks in any of said engaging positions preventing removal of said tray.

5. In combination with a chair having closed tubular arms and a tray for detachable connection to said arms, the means for detachably connecting said tray which comprises horizontally spaced mounting brackets carried by said tray and open from below for positioning on each of said arms, locking hook members pivotally mounted on each of said brackets on horizontal pivots parallel to said arms and each having an operating handle portion for moving said hook members to release positions, and a hook for swinging movement to different engaging positions beneath said arms, said hook having an edge portion for contact with said arm in an engaging position permitting limited horizontal movement of said tray along said arm, an edge portion for contact in a groove in said arm preventing horizontal and vertical movement of said tray with respect to said arm and a self tightening edge portion for engagement in said groove, and said hooks in any of said engaging positions preventing removal of said tray.

* * * * *

UNITED STATES PATENT OFFICE

CERTIFICATE OF CORRECTION

Patent No. 4,105,247 Dated August 8, 1978

Inventor(s) David Saint

It is certified that error appears in the above-identified patent and that said Letters Patent are hereby corrected as shown below:

Abstract,

Line 4, after "hooks" change "fo" to - for -

Column 2,

Line 1, after "safe" change "ad" to - and -

Column 6,

Line 10, after "verging" change "said" to - side -

Signed and Sealed this

*Twenty-third* Day of *January 1979*

[SEAL]

*Attest:*

RUTH C. MASON
*Attesting Officer*

DONALD W. BANNER
*Commissioner of Patents and Trademarks*